US012523207B1

(12) United States Patent
Chuang

(10) Patent No.: US 12,523,207 B1
(45) Date of Patent: Jan. 13, 2026

(54) AIR PUMP WITH INTERNAL TOOL STORAGE

(71) Applicant: Louis Chuang, Taichung (TW)

(72) Inventor: Louis Chuang, Taichung (TW)

( * ) Notice: Subject to any disclaimer, the term of this patent is extended or adjusted under 35 U.S.C. 154(b) by 0 days.

(21) Appl. No.: 19/061,148

(22) Filed: Feb. 24, 2025

(51) Int. Cl.
*F04B 33/00* (2006.01)
*F04B 39/00* (2006.01)

(52) U.S. Cl.
CPC ..... *F04B 33/005* (2013.01); *F04B 39/0005* (2013.01)

(58) Field of Classification Search
CPC .. F04B 33/00–005; F04B 53/14; F04B 53/16; F04B 39/0005; F04B 39/125; F04B 29/00
USPC ..... 417/460
See application file for complete search history.

(56) References Cited

U.S. PATENT DOCUMENTS 605,453 A * 6/1898 Sweigard ..... B25B 13/463 81/170
3,981,625 A * 9/1976 Wickenberg ..... G01L 17/00 417/63
5,433,136 A * 7/1995 Lung-Po ..... F04B 33/005 92/58.1
5,690,016 A * 11/1997 Hwang ..... B62J 11/02 92/58.1
6,270,327 B1 * 8/2001 Wolz ..... F04B 33/005 417/547
9,869,306 B2 1/2018 Yang et al.
10,359,033 B2 * 7/2019 Hermansen ..... F04B 39/14
11,480,167 B2 * 10/2022 Wu ..... F04B 33/005
11,655,808 B2 * 5/2023 Wu ..... F04B 27/005 417/523
2017/0184083 A1 * 6/2017 Wang ..... F04B 33/005
2017/0292507 A1 * 10/2017 Staples ..... B62K 19/32

FOREIGN PATENT DOCUMENTS

BE 901534 A * 5/1985 ..... B25F 1/00
CN 204845890 U * 12/2015
CN 211819830 U 10/2020
KR 870002733 Y1 * 8/1987 ..... F04B 9/14
TW 462439 U 11/2001
TW M618279 U * 10/2021

* cited by examiner

*Primary Examiner* — Thomas Fink
(74) *Attorney, Agent, or Firm* — MUNCY, GEISSLER, OLDS & LOWE, P.C.

(57) ABSTRACT

An air pump comprises a pumping assembly and an internal tool storage system. The pumping assembly includes a nozzle head, piston tube, and cylinder. A tool set is housed within the piston tube and includes a tubular member with first storage cavity and cap member with second storage cavity. The cavities maintain air flow communication while storing repair tools. A repair needle can be mounted alternatively to the nozzle head or cap member. The invention enables integration of inflation and repair capabilities in a single device.

20 Claims, 7 Drawing Sheets

AIR PUMP WITH INTERNAL TOOL STORAGE

BACKGROUND OF THE INVENTION

The present invention relates to an air pump, and more particularly to an air pump with internal tool storage capabilities.

During rides, tires can lose pressure or go flat, affecting performance. An air pump enables riders to maintain proper tire pressure, which is why most bicycles are equipped with portable pumps.

However, conventional air pumps are limited to tire pressure adjustment functions. Insufficient tire pressure often results from tire damage, and addressing such situations requires not only an air pump but also tire repair tools. Carrying both an air pump and various repair tools during rides creates an unnecessary burden for users.

The present invention is, therefore, intended to obviate or at least alleviate the problems encountered in the prior art.

SUMMARY OF THE INVENTION

The present invention provides an air pump that includes a pumping assembly with a nozzle head, a piston tube, and a cylinder. The piston tube includes one end that can be detached and connected to the nozzle head, and the cylinder is sleeved on the end of the piston tube opposite the nozzle head. A tool set is located inside the piston tube and can be detached from the nozzle head. The tool set comprises a tubular member that can be detached from the nozzle head, a cap member that can be detached from the opposite end of the tubular member, and a repair needle connected to the end of the cap member away from the tubular member. The tubular member contains a first storage cavity, and the cap member contains a second storage cavity that connects with the first storage cavity.

The nozzle head includes an air inlet, and the tubular member connects to this air inlet. The first storage cavity runs through the tubular member and connects with the air inlet. The cap member includes a hole that links the second storage cavity to the cap member's outer edge. This design allows air from the piston tube to enter both storage cavities and reach the air inlet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the concept upon which this disclosure is based may readily be utilized as a basis for designing other structures, methods, and systems for carrying out the several purposes of the invention. It is important, therefore, that the claims be regarded as including such equivalent constructions insofar as they do not deviate from the spirit and scope of the invention.

Furthermore, the purpose of the abstract is to enable the general public, particularly scientists, engineers, and practitioners in the field who may not be familiar with patent or legal terminology, to quickly determine the nature and essence of the technical information through a brief examination. The abstract is not meant to define the invention, which is determined by the claims, nor is it intended to limit the scope of the invention in any manner.

Other objectives, advantages, and new features of the invention will become apparent from the following detailed description of the invention when considered in conjunction with the accompanied drawings.

DETAILED DESCRIPTION OF THE INVENTION

Figure 1:
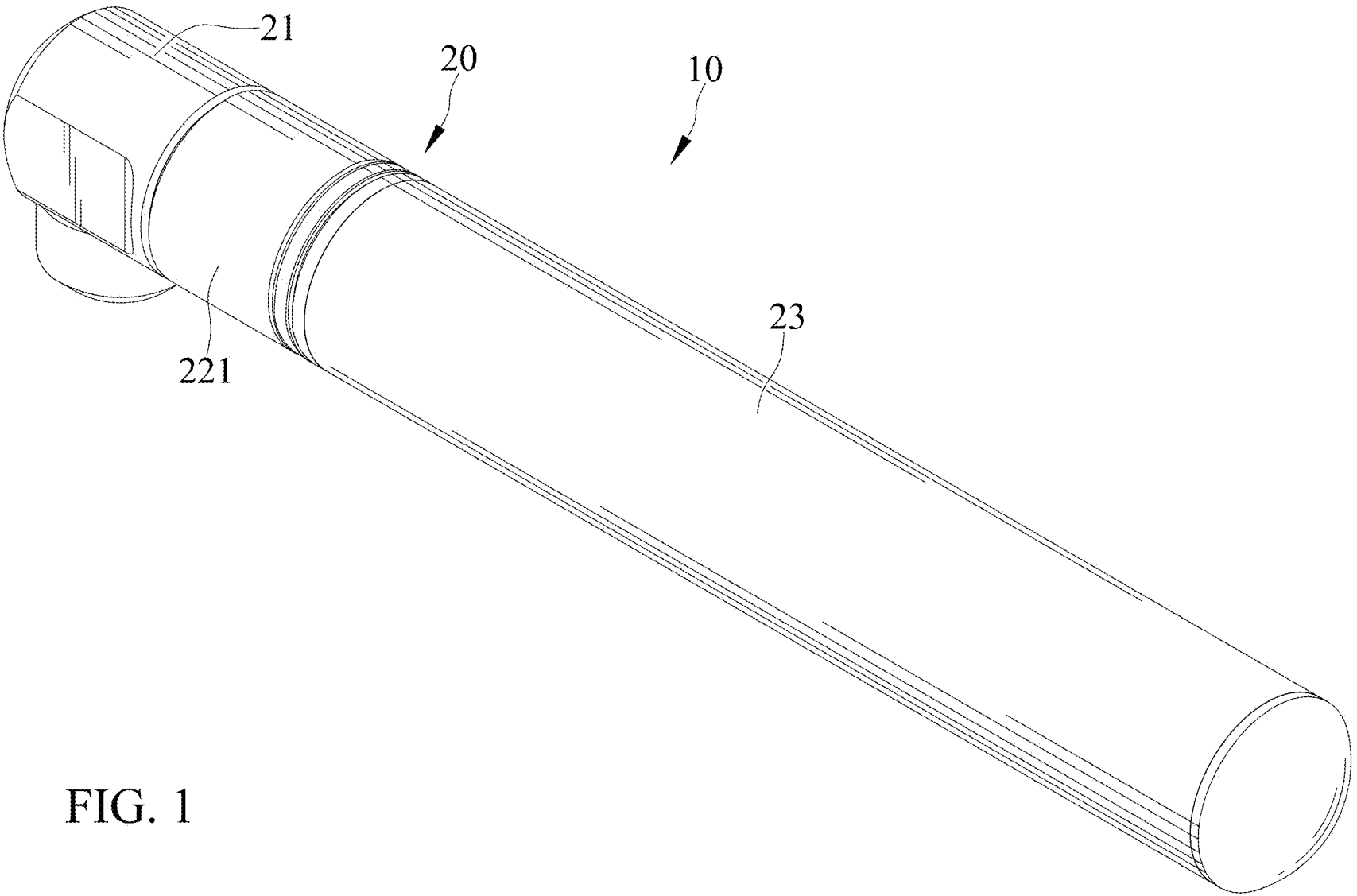
FIG. 1 is a perspective view of an air pump according to the present invention.
Figure 2:
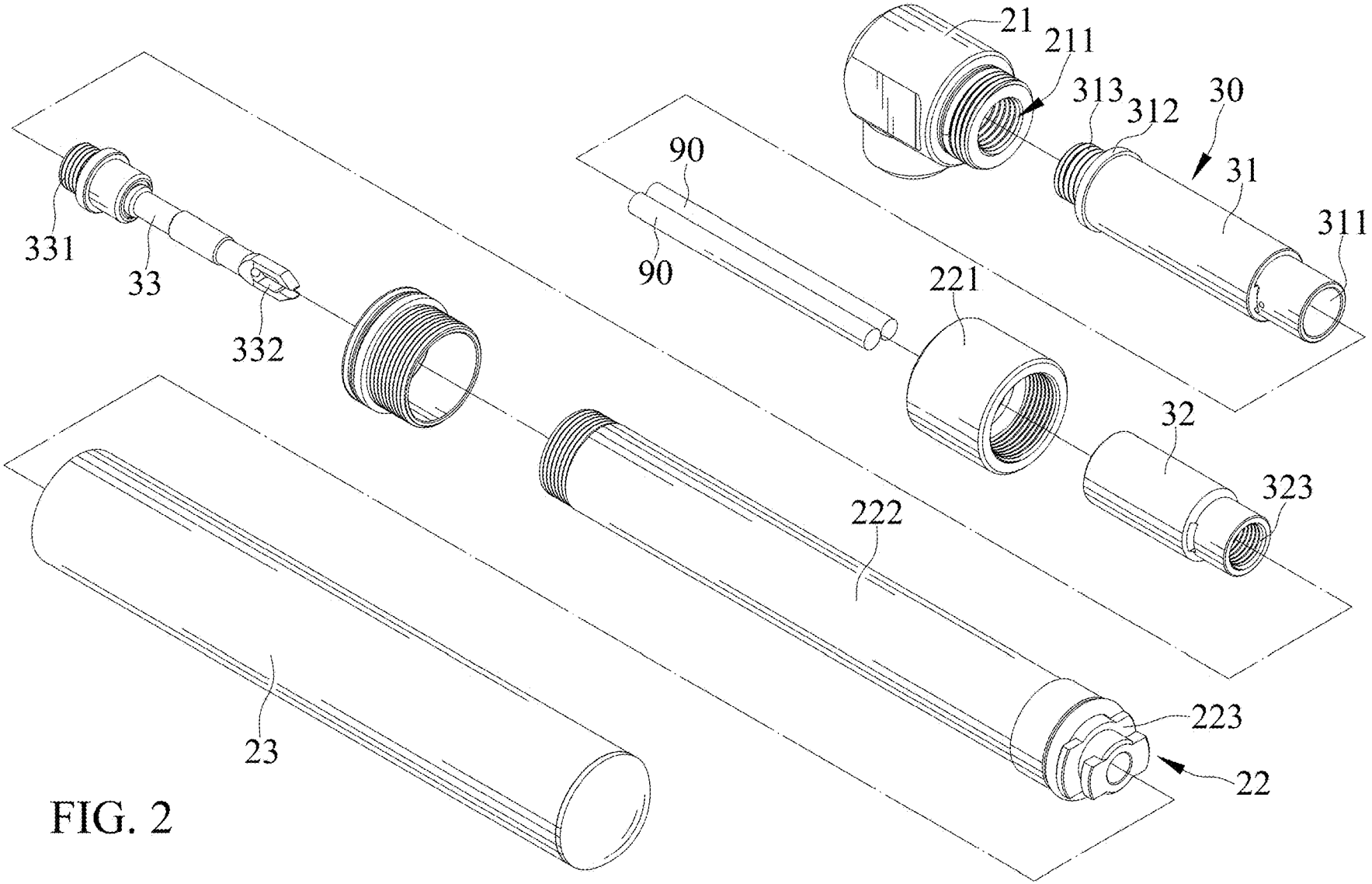
FIG. 2 is an exploded perspective view of the air pump of FIG. 1.
Figure 3:
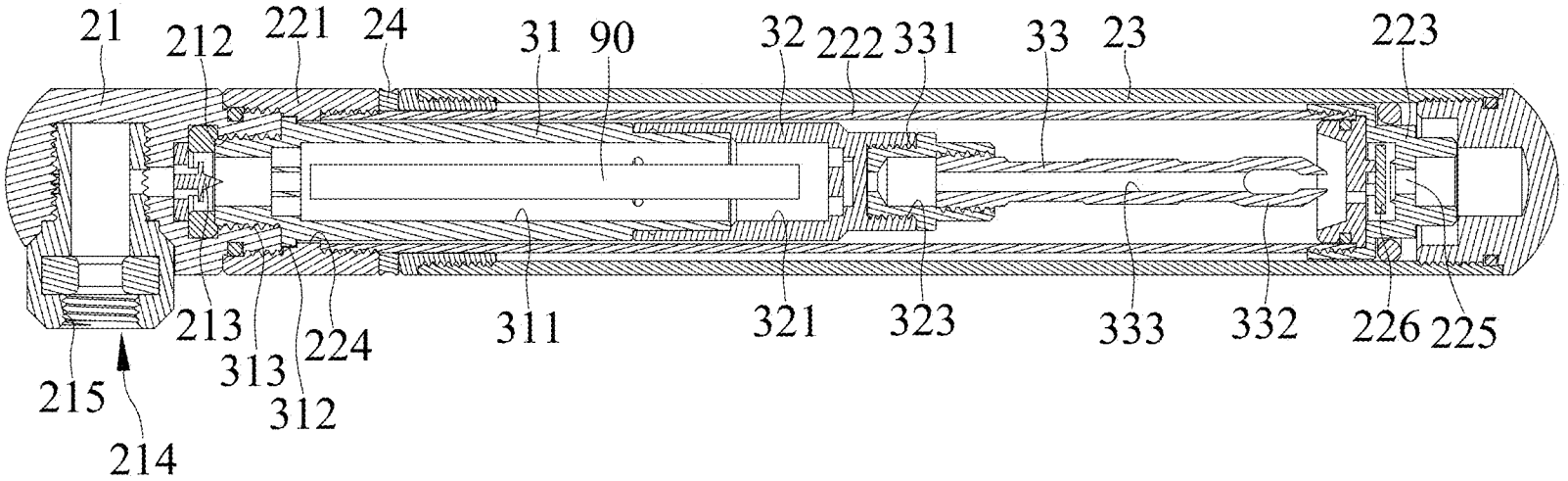
FIG. 3 is a cross-sectional view of the air pump of FIG. 1.
Figure 4:
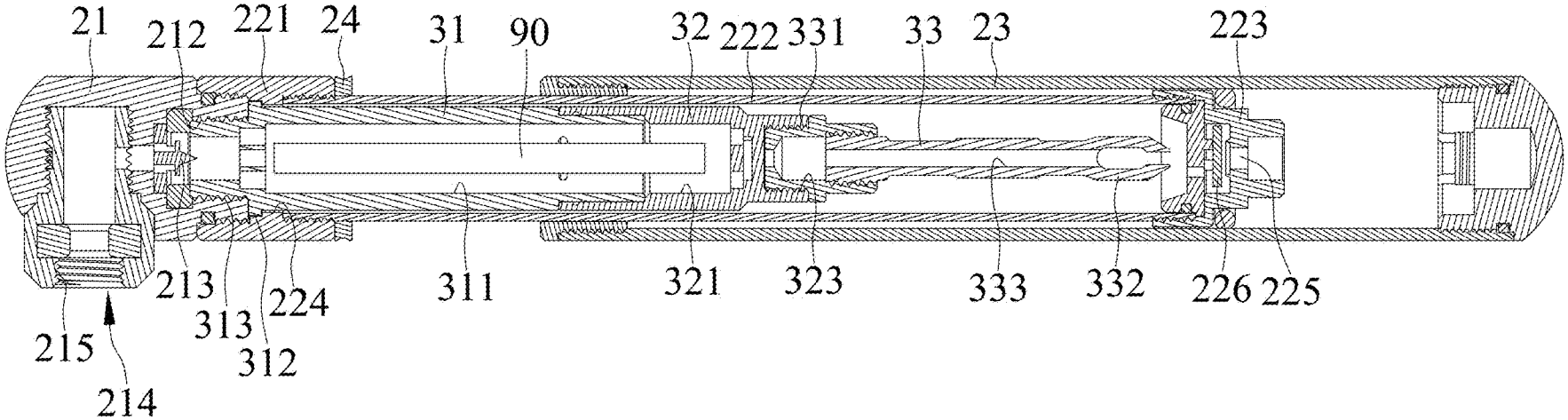
FIG. 4 is cross-sectional view of the air pump of FIG. 1, showing a cylinder in an extended position.
Figure 5:
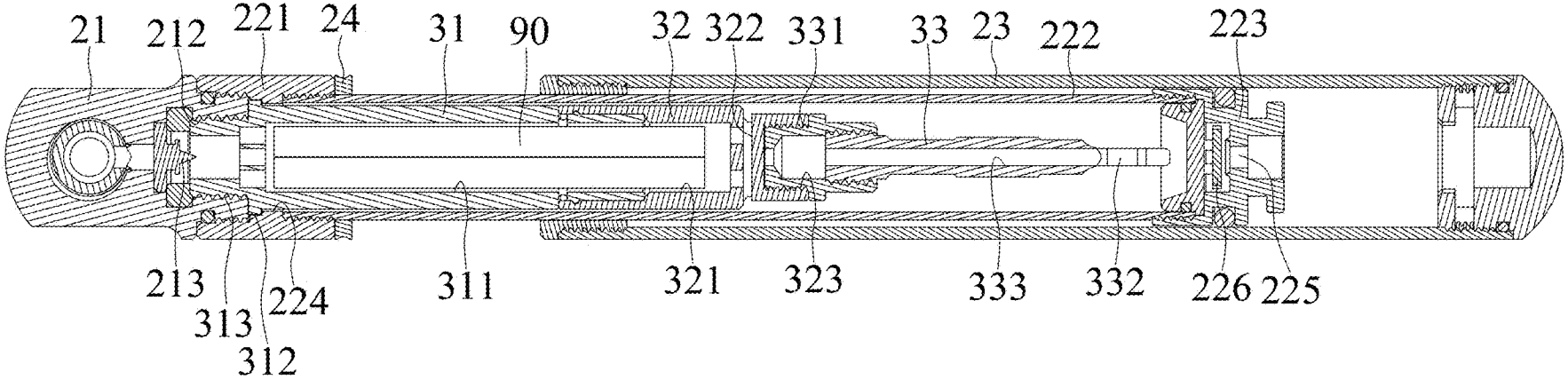
FIG. 5 is another cross-sectional view of the air pump of FIG. 1, showing the cylinder in an extended position.
Figure 6:
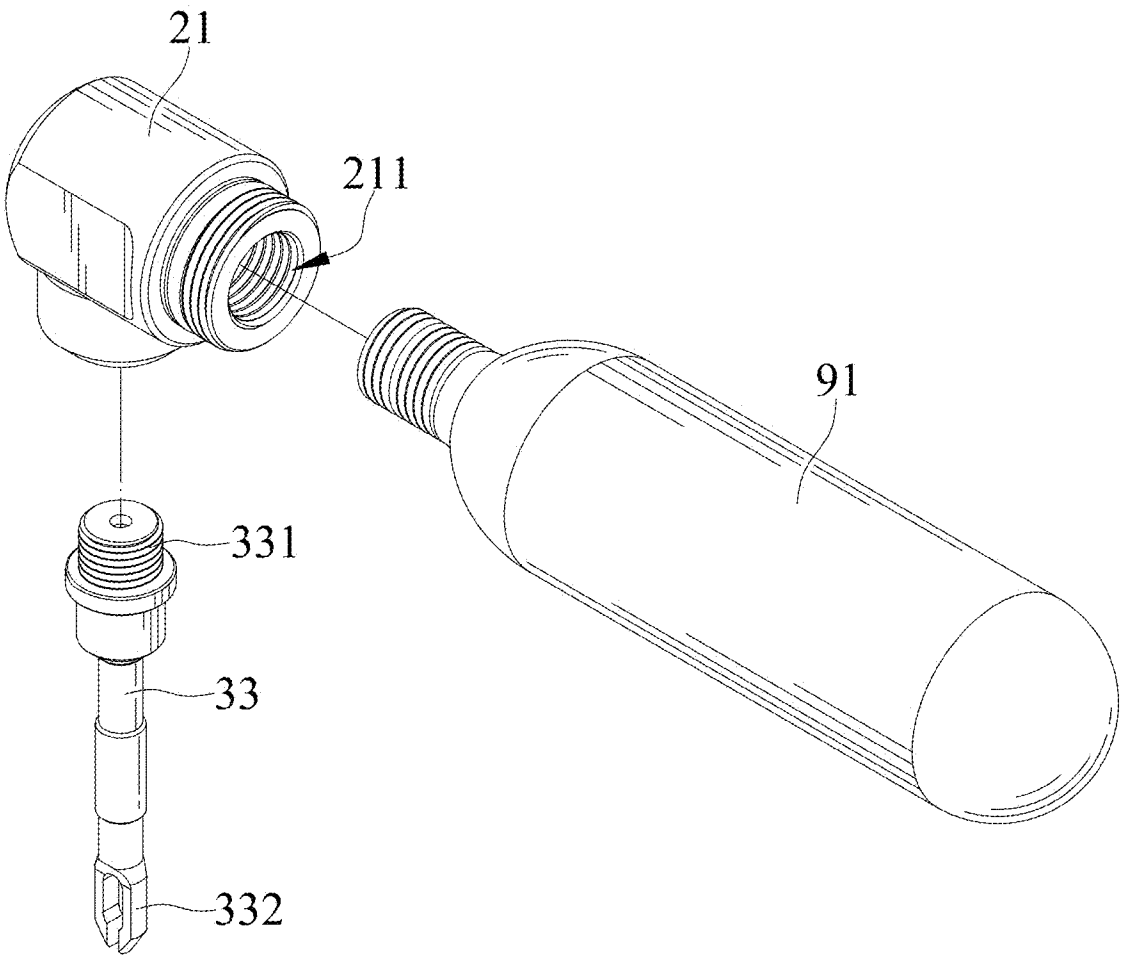
FIG. 6 is an exploded perspective view of the air pump of FIG. 1, showing a nozzle head assembly with a repair needle.
Figure 7:
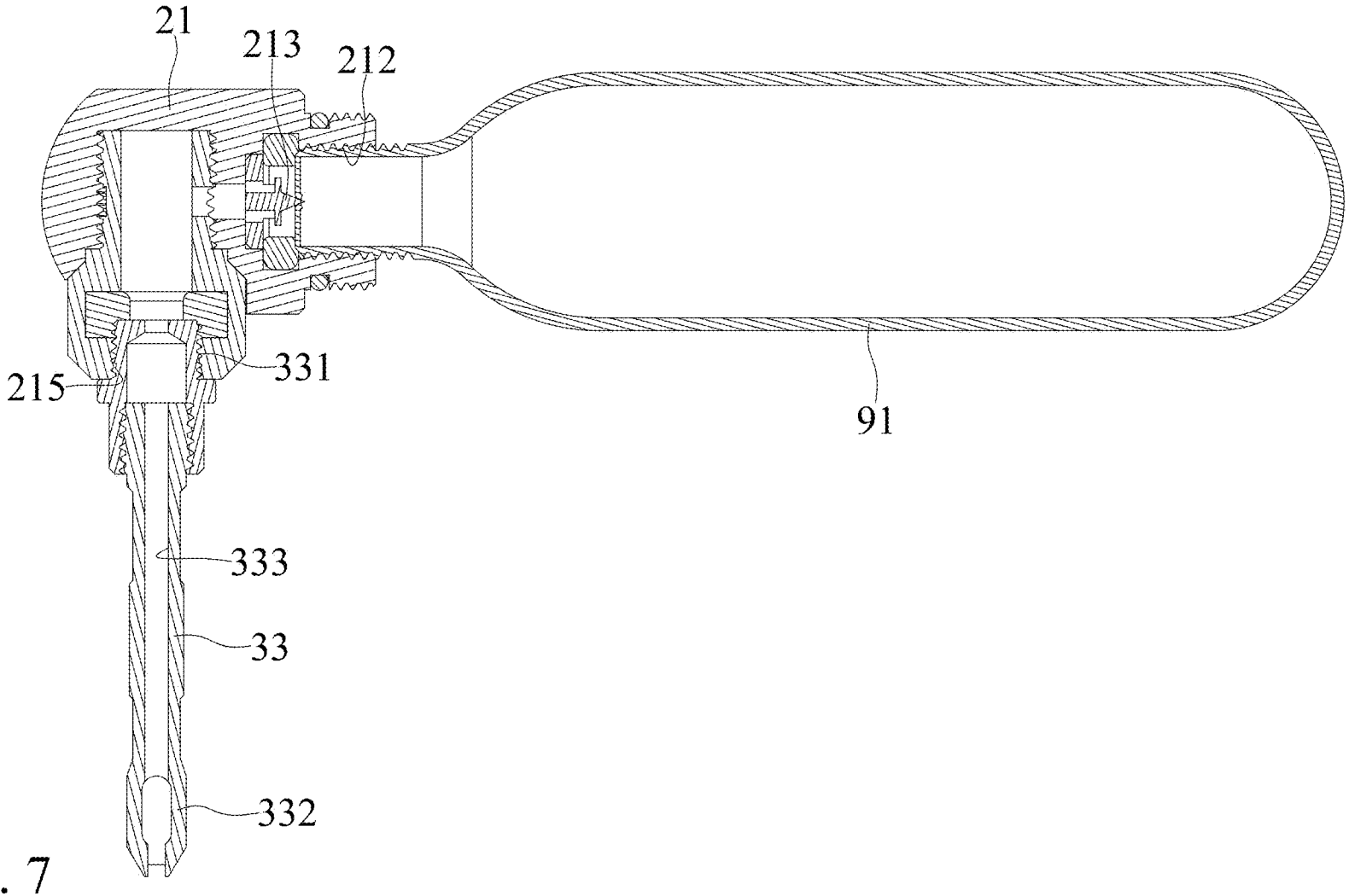
FIG. 7 is a cross-sectional view of the air pump of FIG. 1, showing the nozzle head assembly with the repair needle.

Referring to FIGS. 1-7, an air pump 10 according to the present invention comprises a pumping assembly 20 and a tool set 30.

The pumping assembly 20 includes a nozzle head 21, a piston tube 22, and a cylinder 23. One end of the piston tube 22 is detachably connected to the nozzle head 21, and the cylinder 23 is sleeved on the end of the piston tube 22 opposite to the nozzle head 21.

The tool set 30 is located within the piston tube 22 and is detachably connected to the nozzle head 21.

The tool set 30 includes a tubular member 31, a cap member 32, and a repair needle 33. The tubular member 31 is detachably connected to the nozzle head 21. The tubular member 31 includes a hollow first storage cavity 311. The cap member 32 is detachably connected to the end of the tubular member 31 opposite to the nozzle head 21. The cap member 32 includes a hollow second storage cavity 321 that communicates with the first storage cavity 311. The repair needle 33 is connected to the end of the cap member 32 opposite to the tubular member 31.

The nozzle head 21 includes an air inlet 211. The tubular member 31 is detachably connected to the air inlet 211. The first storage cavity 311 extends through the tubular member 31 and communicates with the air inlet 211. The cap member 32 includes a hole 322 that connects the second storage cavity 321 with the outer periphery of the cap member 32. Air from within the piston tube 22 can enter the first storage cavity 311 and the second storage cavity 321 through the hole 322 and reach the air inlet 211.

The tubular member 31 includes a first flange 312 along its radial outer periphery. The piston tube 22 includes a connecting ring 221, a tube body 222, and a piston head 223. The connecting ring 221 is sleeved on the tubular member 31 and detachably connected to the nozzle head 21. The connecting ring 221 includes a second flange 224 on its inner periphery that abuts against the side of the first flange 312 opposite to the nozzle head 21. One end of the tube body 222 connects to the connecting ring 221. The piston head 223 connects to the end of the tube body 222 opposite to the connecting ring 221. The outer periphery of the piston head 223 abuts against the inner periphery of the cylinder 23.

The piston head 223 includes a through hole 225 and a one-way valve 226 in the through hole 225. The one-way valve 226 only allows air from the cylinder 23 to pass through the through hole 225 and enter the tube body 222.

The pumping assembly 20 includes a buffer ring 24 capable of elastic deformation. The buffer ring 24 is sleeved on the outer periphery of the tube body 222 and abuts against the end of the connecting ring 221 opposite to the nozzle head 21.

The nozzle head 21 includes an internal thread portion 212 and a piercing cone 213. The internal thread portion 212 is located on the inner periphery of the air inlet 211. The internal thread portion 212 has a specification of ⅜"-24UNF. The piercing cone 213 is located within the air inlet 211 adjacent to the internal thread portion 212 and on the side opposite to the tubular member 31. The tubular member 31 includes an external thread portion 313 along its radial outer periphery that threadedly engages with the internal thread portion 212. The first flange 312 is located on the side of the external thread portion 313 opposite to the nozzle head 21.

The nozzle head 21 includes an air outlet 214 in communication with the air inlet 211. The air outlet 214 includes a first connection portion 215. The cap member 32 includes a second connection portion 323 on its end opposite to the tubular member 31. The repair needle 33 includes a third connection portion 331 at one end. The third connection portion 331 can selectively connect to either the first connection portion 215 or the second connection portion 323.

In this embodiment, the first connection portion 215 and the second connection portion 323 include internal thread structures, and the third connection portion 331 includes an external thread structure. The third connection portion 331 can selectively threadedly engage with either the first connection portion 215 or the second connection portion 323.

The repair needle 33 includes a repair portion 332 at its end opposite to the third connection portion 331. The repair needle 33 includes a filling hole 333 extending through it that connects the third connection portion 331 with the repair portion 332.

The air pump 10 operates in two distinct modes. In the pumping mode, air enters the cylinder 23 during the extension stroke, the one-way valve 226 allows air to flow into the tube body 222, air travels through the hole 322 into the storage cavities 311 and 321, and air exits through the nozzle head 21 to inflate the tire. In the repair mode, the tool set 30 is accessed by detaching the piston tube 22 from the nozzle head 21, the repair needle 33 can be connected to either the nozzle head 21 or cap member 32, and the storage cavities 311 and 321 can hold repair materials such as tire patches.

In view of the foregoing, the air pump 10 achieves efficient functionality while maintaining internal storage for tools, creating a space-saving effect. When the tool set 30 is stored within the pumping assembly 20, compressing the cylinder 23 forces air through the through hole 225 and into the tube body 222. This air then reaches the nozzle head 21 through the hole 322, first storage cavity 311, and second storage cavity 321, allowing the air pump 10 to maintain its basic pumping function while storing the tool set 30. The first storage cavity 311 and second storage cavity 321 can store tire repair strips 90. The air inlet 211 can be connected to a high-pressure air cylinder 91, and the repair needle 33 can be connected to the air outlet 214 to simultaneously perform tire pressure supplementation and repair operations.

Although specific embodiments have been illustrated and described, numerous modifications and variations are still possible without departing from the scope of the invention. The scope of the invention is limited by the accompanying claims.

The invention claimed is:

1. An air pump comprising:

a pumping assembly including a nozzle head, a piston tube, and a cylinder, wherein a first end of the piston tube is detachably connected to the nozzle head, and wherein the cylinder is sleeved on a second end of the piston tube; and a tool set located inside the piston tube and detachably connected to the nozzle head.

2. The air pump according to claim 1, wherein the tool set comprises a tubular member detachably connected to the nozzle head, a cap member detachably connected to an end of the tubular member opposite to the nozzle head, and a repair needle connected to an end of the cap member opposite to the tubular member, and wherein the tubular member includes a first storage cavity, and the cap member includes a second storage cavity in communication with the first storage cavity.

3. The air pump according to claim 2, wherein the nozzle head includes an air inlet, wherein the tubular member is detachably connected to the air inlet, wherein the first storage cavity extends through the tubular member and communicates with the air inlet, wherein the cap member includes a hole connecting the second storage cavity with an outer periphery of the cap member, and wherein air from the piston tube enters the first storage cavity and second storage cavity through the hole and reaches the air inlet.

4. The air pump according to claim 3, wherein the tubular member includes a first flange along its radial outer periphery, wherein the piston tube comprises a connecting ring, a tube body, and a piston head, wherein the connecting ring is sleeved on the tubular member and detachably connected to the nozzle head, wherein the connecting ring includes a second flange on its inner periphery that abuts against a side of the first flange opposite to the nozzle head, wherein one end of the tube body connects to the connecting ring, wherein the piston head connects to an end of the tube body opposite to the connecting ring, and wherein an outer periphery of the piston head abuts against an inner periphery of the cylinder.

5. The air pump according to claim 4, wherein the piston head includes a through hole with a one-way valve that only permits air from the cylinder to pass through the through hole and enter the tube body.

6. The air pump according to claim 4, further comprising a buffer ring capable of elastic deformation, wherein the buffer ring is sleeved on the outer periphery of the tube body and abuts against an end of the connecting ring opposite to the nozzle head.

7. The air pump according to claim 4, wherein the nozzle head includes an internal thread portion and a piercing cone, wherein the internal thread portion is located on an inner periphery of the air inlet and has a specification of ⅜"-24UNF, wherein the piercing cone is located within the air inlet adjacent to the internal thread portion and on a side opposite to the tubular member, wherein the tubular member includes an external thread portion along its radial outer periphery that threadedly engages with the internal thread portion, and wherein the first flange is located on a side of the external thread portion opposite to the nozzle head.

8. The air pump according to claim 3, wherein the nozzle head includes an air outlet in communication with the air inlet, wherein the air outlet includes a first connection portion, wherein the cap member includes a second connection portion on an end opposite to the tubular member, wherein the repair needle includes a third connection portion at one end, and wherein the third connection portion selectively connects to either the first connection portion or the second connection portion.

9. The air pump according to claim 8, wherein the first connection portion and second connection portion include internal thread structures, wherein the third connection portion includes an external thread structure, and wherein the third connection portion selectively threadedly engages with either the first connection portion or the second connection portion.

10. The air pump according to claim 8, wherein the repair needle includes a repair portion at an end opposite to the third connection portion, and wherein the repair needle defines a filling hole extending through the repair needle that connects the third connection portion with the repair portion.

11. The air pump according to claim 1, wherein the piston tube includes a connecting ring, a tube body, and a piston head, and wherein the tube body is disposed between the connecting ring and the piston head.

12. The air pump according to claim 11, wherein the connecting ring is sleeved on the tubular member, wherein the connecting ring includes a second flange on its inner periphery, and wherein the second flange abuts against a side of a first flange of the tubular member.

13. The air pump according to claim 2, wherein the nozzle head includes an air outlet, wherein the air outlet includes a first connection portion, wherein the cap member includes a second connection portion, and wherein the repair needle includes a third connection portion selectively connectable to either the first connection portion or the second connection portion.

14. The air pump according to claim 13, wherein the first connection portion and the second connection portion include internal thread structures, and wherein the third connection portion includes an external thread structure engageable with either internal thread structure.

15. The air pump according to claim 3, wherein the hole includes a plurality of through-holes circumferentially arranged around the cap member, and the through-holes provide fluid communication between the second storage cavity and the piston tube.

16. The air pump according to claim 5, wherein the one-way valve includes a flexible membrane, and wherein the flexible membrane is configured to deflect away from the through hole when air pressure in the cylinder exceeds air pressure in the tube body.

17. The air pump according to claim 7, wherein the piercing cone is configured to pierce a valve of a high-pressure air cylinder, and wherein the internal thread portion is configured to engage with threads of the high-pressure air cylinder.

18. The air pump according to claim 8, wherein the repair needle includes a repair portion having a tapered tip, and wherein the filling hole extends from the third connection portion to the repair portion.

19. The air pump according to claim 2, wherein the first storage cavity is configured to store tire repair strips, and wherein the second storage cavity is configured to store additional repair tools.

20. The air pump according to claim 1, wherein the tool set is configured to be completely contained within the piston tube during a pumping operation, and wherein air flow from the cylinder to the nozzle head is maintained with the tool set installed.

* * * * *